US006846092B2

(12) United States Patent
Taylor et al.

(10) Patent No.: US 6,846,092 B2
(45) Date of Patent: Jan. 25, 2005

(54) LIGHTING FIXTURE DEVICE FOR A BUILDING STRUCTURE

(76) Inventors: James T. Taylor, 323 Crawford Rd., Scottsboro, AL (US) 35769; Deborah A. Light, 1110 Wildwood Ave., Scottsboro, AL (US) 35769

( * ) Notice: Subject to any disclaimer, the term of this patent is extended or adjusted under 35 U.S.C. 154(b) by 0 days.

(21) Appl. No.: 10/073,394

(22) Filed: Feb. 12, 2002

(65) Prior Publication Data

US 2002/0075680 A1 Jun. 20, 2002

(51) Int. Cl.[7] ..... F21V 21/00

(52) U.S. Cl. ..... 362/249; 362/145; 362/374; 362/387

(58) Field of Search ..... 362/249, 152, 362/151, 267, 351, 359, 360, 361, 374, 457, 387, 388

(56) References Cited

U.S. PATENT DOCUMENTS 5,311,414 A * 5/1994 Branham, Sr. ..... 348/390.1
5,404,279 A * 4/1995 Wood ..... 362/145
5,510,966 A * 4/1996 Konecny ..... 362/249
5,813,751 A * 9/1998 Shaffer ..... 362/249
5,816,687 A * 10/1998 Tapp ..... 362/250
6,183,104 B1 * 2/2001 Ferrara ..... 362/145
6,302,560 B1 * 10/2001 Lai ..... 362/249
6,364,508 B1 * 4/2002 Moreland ..... 362/249

* cited by examiner

*Primary Examiner*—John Anthony Ward

(57) ABSTRACT

A lighting fixture device for a building structure for allowing a user to easily and quickly decorate one's building structure with lights. The lighting fixture device for a building structure includes an elongate storage unit having a top, bottom, and side walls, and also having a storage compartment therein with the bottom wall having an opening disposed therethrough and with the elongate storage unit being adapted to securely mount to the building structure; and also includes a cover member being removably closed over the opening of the elongate storage unit; and further includes a light-emitting assembly being removably stored in the elongate storage unit; and also includes an assembly for securely supporting the light-emitting assembly in the elongate storage unit.

3 Claims, 3 Drawing Sheets

LIGHTING FIXTURE DEVICE FOR A BUILDING STRUCTURE

BACKGROUND OF THE INVENTION

1. Field of the Invention

The present invention relates to outdoor lighting fixtures and more particularly pertains to a new lighting fixture device for a building structure for allowing a user to easily and quickly decorate one's building structure with lights.

2. Description of the Prior Art

The use of outdoor lighting fixtures is known in the prior art. More specifically, outdoor lighting fixtures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,692,993; 5,813,751; 3,569,691; 4,128,863; 5,513,081; and Des. 397,818.

While these devices fulfill their respective, particular objectives and requirements, the aforementioned patents do not disclose a new lighting fixture device for a building structure. The inventive device includes an elongate storage unit having a top, bottom, and side walls, and also having a storage compartment therein with the bottom wall having an opening disposed therethrough and with the elongate storage unit being adapted to securely mount to the building structure; and also includes a cover member being removably closed over the opening of the elongate storage unit; and further includes a light-emitting assembly being removably stored in the elongate storage unit; and also includes an assembly for securely supporting the light-emitting assembly in the elongate storage unit.

In these respects, the lighting fixture device for a building structure according to the present invention substantially departs from the conventional concepts and designs of the prior art, and in so doing provides an apparatus primarily developed for the purpose of allowing a user to easily and quickly decorate one's building structure with lights.

SUMMARY OF THE INVENTION

The general purpose of the present invention, which will be described subsequently in greater detail, is to provide a new lighting fixture device for a building structure apparatus and method which has many of the advantages of the outdoor lighting fixtures mentioned heretofore and many novel features that result in a new lighting fixture device for a building structure which is not anticipated, rendered obvious, suggested, or even implied by any of the prior art outdoor lighting fixtures, either alone or in any combination thereof.

There has thus been outlined, rather broadly, the more important features of the lighting fixture device for a building structure in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new lighting fixture device for a building structure apparatus and method which has many of the advantages of the outdoor lighting fixtures mentioned heretofore and many novel features that result in a new lighting fixture device for a building structure which is not anticipated, rendered obvious, suggested, or even implied by any of the prior art outdoor lighting fixtures, either alone or in any combination thereof.

Still another object of the present invention is to provide a new lighting fixture device for a building structure for allowing a user to easily and quickly decorate one's building structure with lights.

Still yet another object of the present invention is to provide a new lighting fixture device for a building structure that can be easily and conveniently installed.

Even still another object of the present invention is to provide a new lighting fixture device for a building structure that allows the user to easily display lights and to also store the lights when not being used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
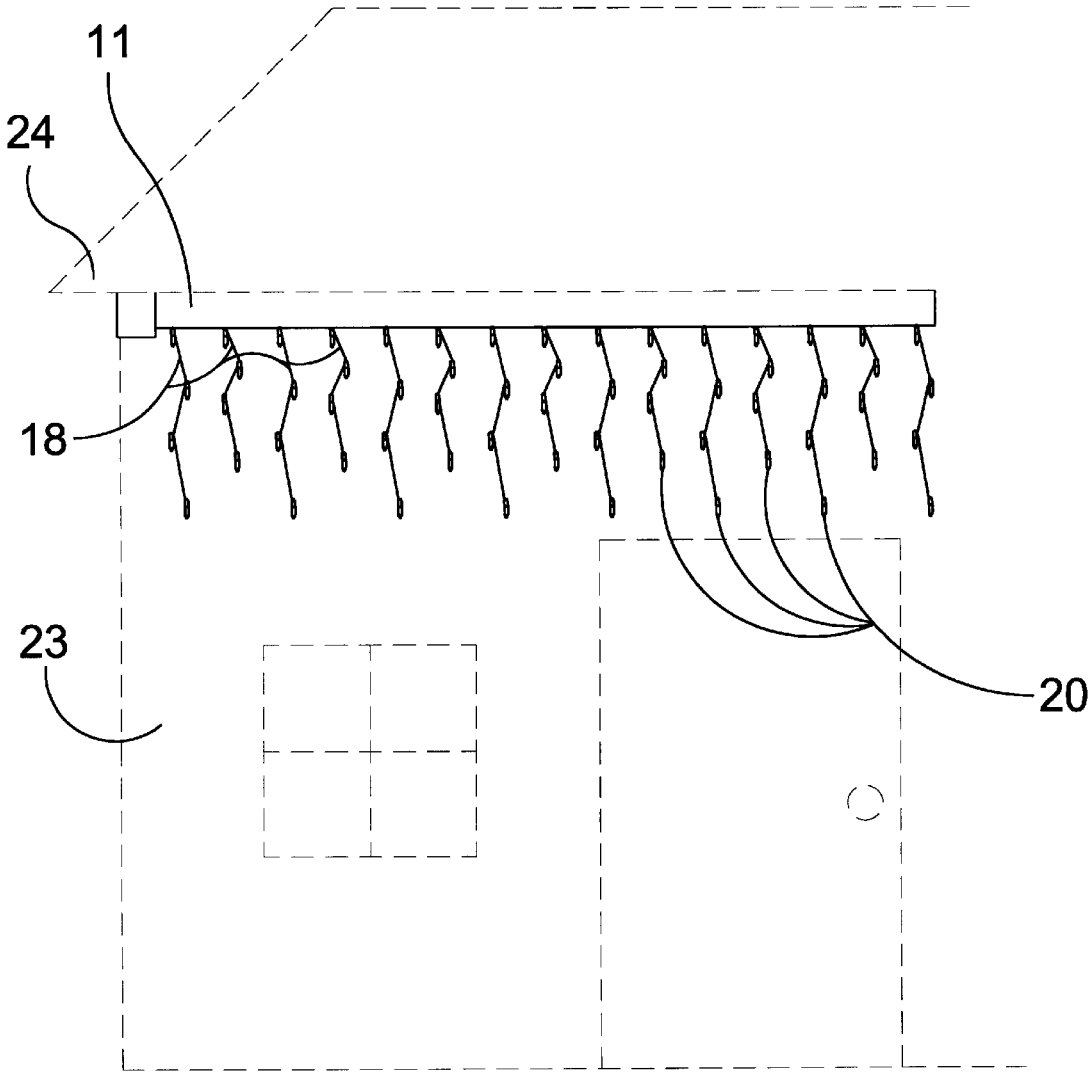
FIG. 1 is a perspective view of a new lighting fixture device for a building structure according to the present invention and shown in use.
Figure 2:
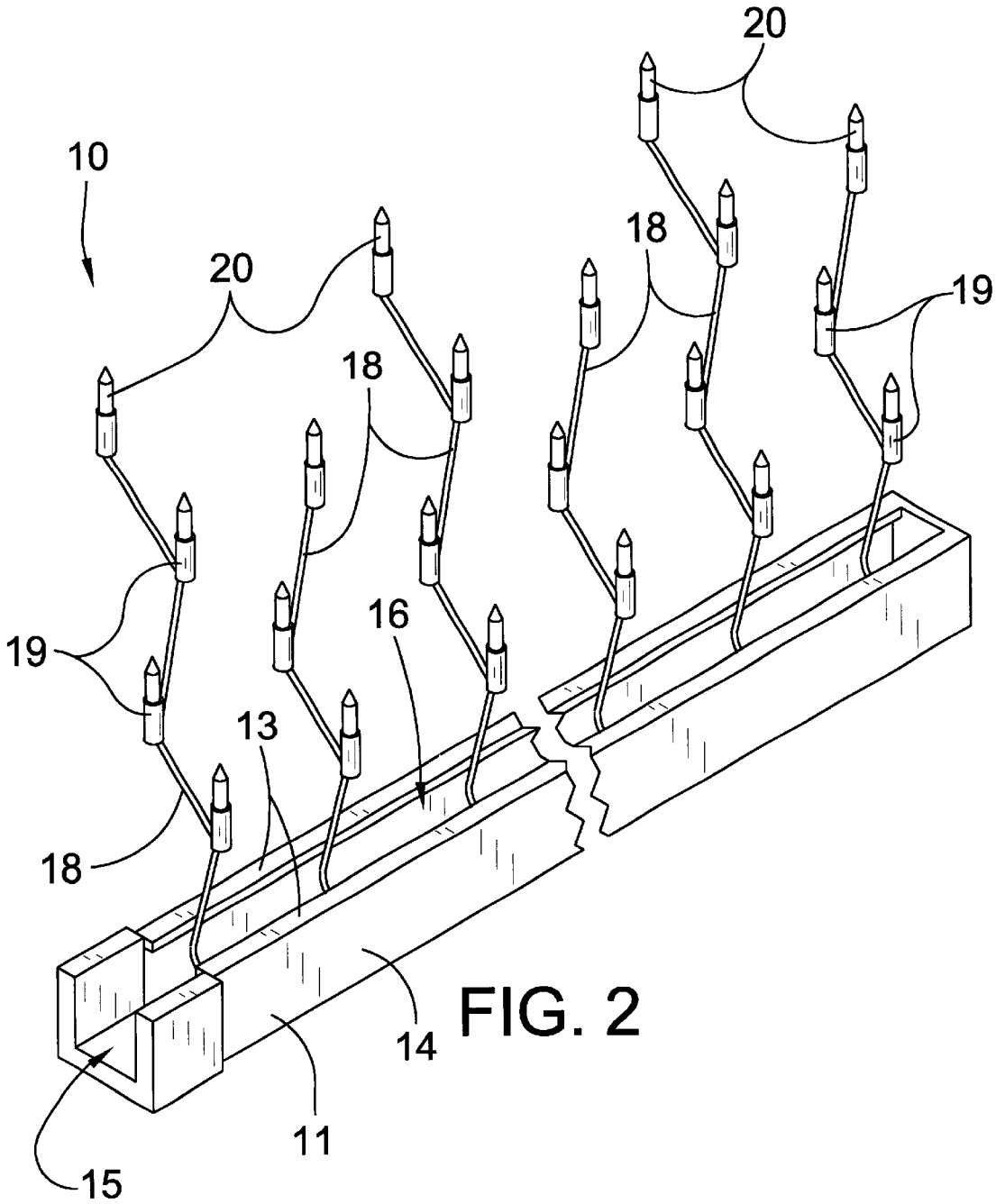
FIG. 2 is a bottom perspective view of the present invention.
Figure 4:
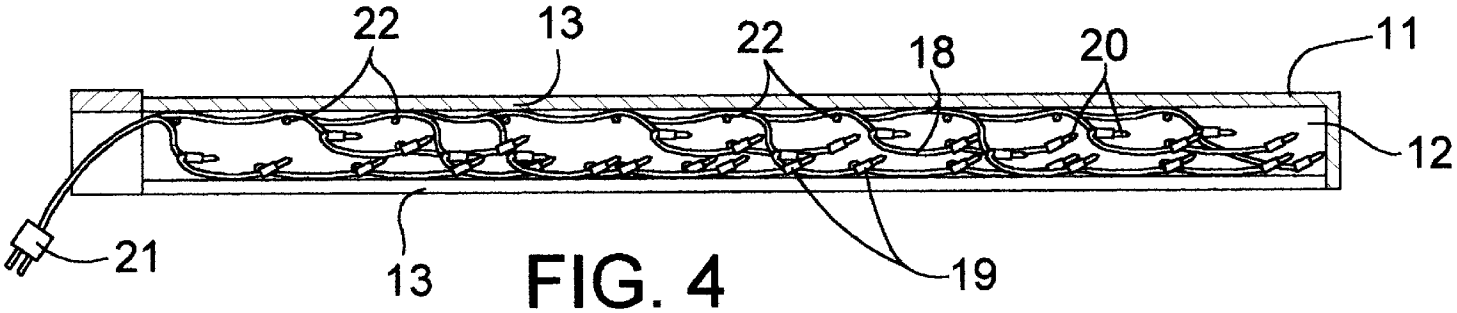
FIG. 4 is another bottom perspective view of the present invention with the cover member closed over the storage unit.
Figure 3:
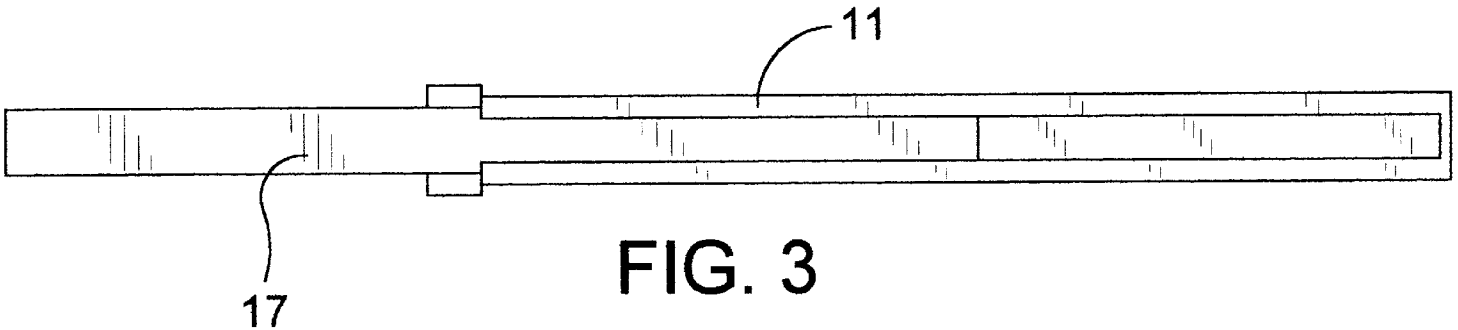
FIG. 3 is a bottom plan view of the present invention.
Figure 5:
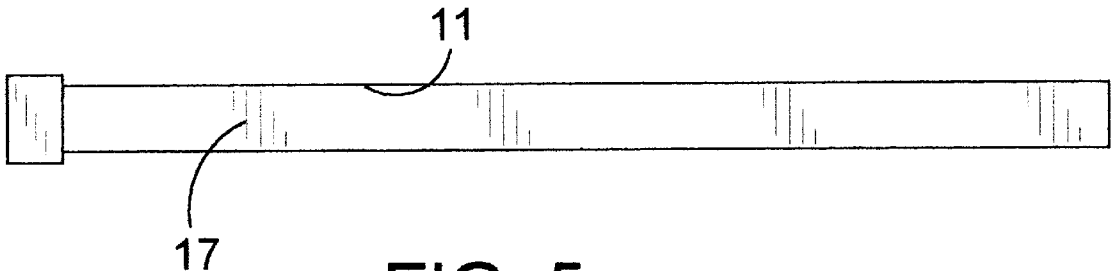
FIG. 5 is a top plan view of the present invention.

With reference now to the drawings, and in particular to FIGS. 1 through 5 thereof, a new lighting fixture device for a building structure embodying the principles and concepts of the present invention and generally designated by the reference numeral 10 will be described.

As best illustrated in FIGS. 1 through 5, the lighting fixture device for a building structure 10 generally comprises an elongate storage unit 11 having a top, bottom, and side walls 12–14, and also having a storage compartment 15 therein. The bottom wall 13 has an opening 16 being disposed therethrough. The elongate storage unit 11 is adapted to securely and conventionally mount to the building structure 23. The elongate storage unit 11 is adapted to be securely attached to and suspended from an eave 24 of the building structure 23. The opening 16 extends a length of the elongate storage unit 11 with the bottom wall 13 forming tracks.

A cover member 17 is removably and conventionally closed over the opening 16 of the elongate storage unit 11. The cover member 17 is movably disposed upon the tracks 13 for opening and closing access to the storage compartment 15. The cover member 17 is an elongate flat piece of rigid material.

A light-emitting assembly is removably stored in the elongate storage unit 11. The light-emitting assembly includes a plurality of wires 18 being interconnected to one another and being stored in the storage compartment 15 of the elongate storage unit 11 and being suspendable therefrom, and also includes a plurality of light sockets 19 being conventionally connected inline to the wires 18 and being spaced therealong, and further includes a plurality of light-emitting members 20 being removably connected to the light sockets 19, and also includes an electrical outlet plug 21 being conventionally connected to at least one of the wires 18.

A means for securely supporting the light-emitting assembly in the elongate storage unit 11 includes a plurality of hooks 22 being conventionally disposed in the storage compartment 15 and being securely and conventionally attached to the side walls 14 of the elongate storage unit 11 for carrying and supporting the wires 18.

In use, the user generally nails the elongate storage unit 11 to an underside of the eave 24, and slides the covert member 17 from over the opening 16 of the elongate storage unit 11 to expose the light-emitting assembly being stored in the storage compartment 15. The user then unwinds portions of the wires 18 from about the hooks 22 to suspend the light-emitting members 20 below the elongate storage unit 11, and plugs the electrical outlet plug 21 into an appropriate electrical outlet; whereupon the light-emitting members 20 are energized. Once finished, the user simply winds the wires 18 about the hooks 22 in the storage compartment 15, and then slides the cover member 17 over the opening 16 of the elongate storage unit 11 to stow away the light-emitting assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the lighting fixture device for a building structure. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lighting fixture device for a building structure comprising:

an elongate storage unit having a top, bottom, and side walls, and also having a storage compartment therein, said bottom wall having an opening disposed therethrough, said elongate storage unit being adapted to securely mount to the building structure said elongate storage unit being adapted to be securely attached to and suspended from an eave of the building structure, said opening extending a length of said elongate storage unit with said bottom wall forming tracks;

a cover member being removably closed over said opening of said elongate storage unit;

a light-emitting assembly being removably stored in said elongate storage unit; and a means for securely supporting said light-emitting assembly in said elongate storage unit.

2. A lighting fixture device for a building structure as described in claim 1, wherein said cover member is movably disposed upon said tracks for opening and closing access to said storage compartment.

3. A lighting fixture device for a building structure as described in claim 2, wherein said cover member is an elongate flat piece of rigid material.

* * * * *